US008623804B2

(12) United States Patent
De Leersnyder et al.

(10) Patent No.: US 8,623,804 B2
(45) Date of Patent: Jan. 7, 2014

(54) THICKENED LIQUID HARD SURFACE CLEANING COMPOSITION

(75) Inventors: Geert Andre De Leersnyder, Wielsbeke (BE); Laure Waegemans, Neder-over-Heembeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/281,470

(22) Filed: Oct. 26, 2011

(65) Prior Publication Data

US 2012/0102668 A1 May 3, 2012

(30) Foreign Application Priority Data

Oct. 29, 2010 (EP) ..... 10189334
Oct. 7, 2011 (EP) ..... 11187302

(51) Int. Cl.
*C11D 17/00* (2006.01)

(52) U.S. Cl.
USPC ..... 510/218; 510/424; 510/426; 510/428; 510/490; 510/503

(58) Field of Classification Search
None
See application file for complete search history.

(56) References Cited

U.S. PATENT DOCUMENTS

| | | | | |
|---|---|---|---|---|
| 4,678,606 | A | 7/1987 | Akhter et al. | |
| 4,681,704 | A | 7/1987 | Bernardino et al. | |
| 4,704,233 | A | 11/1987 | Hartman et al. | |
| 4,950,412 | A * | 8/1990 | Duffin et al. | 510/516 |
| 5,399,285 | A | 3/1995 | Kanluen | |
| 5,929,023 | A | 7/1999 | Durbut | |
| 7,811,387 | B2 | 10/2010 | Scialla et al. | |
| 2002/0069900 | A1 | 6/2002 | Evers | |
| 2002/0069901 | A1 | 6/2002 | Evers | |
| 2011/0000309 | A1 | 1/2011 | Griffiths et al. | |
| 2011/0271979 | A1 | 11/2011 | Mondin et al. | |

FOREIGN PATENT DOCUMENTS

| | | | |
|---|---|---|---|
| DE | 10162648 | A1 | 7/2003 |
| EP | 80 749 | B1 | 4/1986 |
| WO | WO-83/03621 | A1 | 10/1983 |

OTHER PUBLICATIONS

EP International Search report, dated Jan. 17, 2012 (5 pages).
PCT International Search Report, mailed Jan. 16, 2012 (10 pages).

* cited by examiner

*Primary Examiner* — Necholus Ogden, Jr.
(74) *Attorney, Agent, or Firm* — John T. Dipre; Steven W. Miller

(57) ABSTRACT

The present invention relates to a thickened alkaline liquid hard surface cleaning composition comprising a surfactant system and chelant to provide cleaning and shine.

19 Claims, No Drawings

THICKENED LIQUID HARD SURFACE CLEANING COMPOSITION

FIELD OF THE INVENTION

The present invention relates to a thickened liquid hard surface cleaning composition. The thickened liquid hard surface cleaning composition of the present invention was found to exhibit shine and cleaning performance of greasy soils benefits upon cleaning of a hard surface.

BACKGROUND OF THE INVENTION

Liquid compositions for cleaning hard surfaces are well known in the art.

Liquid compositions comprising a surfactant system for cleaning grease soil have been extensively described in the art, especially in the contest of hard surface cleaning applications. Examples of liquid compositions known in the art include liquid hard surface compositions comprising a sulphonated anionic surfactant, an amine oxide surfactant and an ethoxylated alcohol surfactant (EP-A-0 080 749) or compositions comprising an alkyl ethoxylated ether sulfate surfactant, a betaine surfactant, an amine oxide surfactant and an ethoxylated alcohol surfactant (WO 98/50508).

However, the greasy soil removal performance of such hard surface cleaning compositions may still be further improved. In particular, the greasy soil removal performance including the particulate greasy soil removal performance combined with shine performance can be still improved. By the term "particulate greasy soil" is meant herein greasy soil containing particles like dust, sugar, hair etc.

Thus, the objective of the present invention is to provide a stable thickened hard surface cleaning composition exhibiting a greasy soil and/or particulate greasy soil removal performance benefit upon contact of the thickened liquid composition on soil. Additionally, the objective of the present invention is to provide an improved shine benefit.

It has now been found that these objectives can be met by the thickened liquid composition of the present invention.

An advantage of the present invention is that the thickened liquid hard surface cleaning composition may be used to clean hard surfaces made of a variety of materials like glazed and non-glazed ceramic tiles, enamel, stainless steel, Inox®, Formica®, vinyl, no-wax vinyl, linoleum, melamine, glass, plastics and plastified wood.

BACKGROUND ART

EP-A-0 080 749 discloses liquid hard surface detergent compositions comprising a sulphonated anionic surfactant, an amine oxide surfactant and an ethoxylated alcohol surfactant.

WO 98/50508 discloses all-purpose cleaning compositions comprising an alkyl ethoxylated ether sulfate surfactant, a betaine surfactant, an amine oxide surfactant and an ethoxylated alcohol surfactant.

EP-A-0 157 443 discloses detergent compositions comprising a semi-polar nonionic detergent, an anionic surfactant and an acylamidoalkylbetaine.

EP-A-0 595 590 discloses liquid hard surface cleaning compositions comprising an amine oxide surfactant, an alkyl anionic surfactant, an alkoxylated nonionic surfactant and a hydrophobically modified polymer.

SUMMARY OF THE INVENTION

The present invention relates to a thickened liquid hard surface cleaning composition comprising:

a) 1.8% to 20.0% by weight of the composition of a surfactant system, comprising an alkoxylated nonionic surfactant, a sulphated or sulphonated anionic surfactant; and a neutralizing co-surfactant, wherein the weight ratio of said anionic surfactant to said neutralizing co-surfactant is from 0.7 to 2.5 and the weight ratio of said anionic surfactant to said nonionic surfactant is from 0.15 to 1.0, and the weight ratio of said neutralizing co-surfactant to said nonionic surfactant is from 0.05 to 1.0; and b) 0.1%-10.0% by weight of the composition of a thickener or mixture thereof; and c) 0.05% to 5.0% by weight of the composition of a chelant or mixture thereof;

wherein said composition has a pH from 9.0 to 11.0 and a viscosity from 50 cps to 600 cps measured at 20° C. with a AD1000 Advanced Rheometer from Atlas® with a shear rate of 10 $s^{-1}$ with a coned spindle of 40 mm with a cone angle of 2° and a truncation of ±60 μm.

The present invention further encompasses a process of cleaning a hard surface with a thickened liquid hard surface cleaning composition according to present invention, wherein said surface is contacted with said composition, preferably wherein said composition is applied onto said surface.

DETAILED DESCRIPTION OF THE INVENTION

The thickened liquid hard surface cleaning composition The compositions according to the present invention are designed as cleaners for a variety of household hard surfaces.

By "household hard surface", it is meant herein any kind of surface typically found in and around houses like kitchens, bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox®, Formica®, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

In a preferred embodiment herein, the liquid compositions herein are aqueous compositions. Therefore, they may comprise from 50% to 99.5% by weight of the total composition of water, preferably from 70% to 98% and more preferably from 80% to 95%.

The compositions according to the present invention are thickened liquid compositions as opposed to the compositions having water like viscosity, solids or gases.

The compositions of the present invention have a viscosity from 50 cps to 600 cps, more preferably of from 100 cps to 500 cps, more preferably from 150 cps to 350 cps, even more preferably from 150 cps to 300 cps and most preferably from 150 cps to 250 cps at 20° C. when measured with a AD1000 Advanced Rheometer from Atlas® shear rate 10 $s^{-1}$ with a coned spindle of 40 mm with a cone angle 2° and a truncation of ±60 μm.

The pH of the compositions herein is from 9.0 to 11.0, preferably from 9.5 to 10.8, more preferably from 10.0 to 10.7, even more preferably from 10.2 to 10.5 and most preferably pH is 10.3. Indeed, it has been surprisingly found that the greasy soil and particulate greasy soil cleaning performance is further improved at these preferred alkaline pH ranges. Accordingly, the compositions herein may further comprise an acid or base to adjust pH as appropriate.

A suitable acid for use herein is an organic and/or an inorganic acid. A preferred organic acid for use herein has a pka of less than 6. A suitable organic acid is selected from the group consisting of citric acid, lactic acid, glycolic acid, succinic acid, glutaric acid and adipic acid and mixtures thereof. A mixture of said acids may be commercially available from BASF under the trade name Sokalan® DCS. A suitable inorganic acid is selected from the group consisting hydrochloric acid, sulphuric acid, phosphoric acid and mixtures thereof.

A typical level of such an acid, when present, is of from 0.01% to 5.0% by weight of the total composition, preferably from 0.04% to 3.0% and more preferably from 0.05% to 1.5%.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (as e.g. monoethanolamine).

Typical levels of such bases, when present, are of from 0.01% to 5.0% by weight of the total composition, preferably from 0.05% to 3.0% and more preferably from 0.1% to 2.0%.

Surfactant System

The thickened liquid hard surface cleaning composition according to present invention comprises a specific surfactant system as described herein, preferably wherein said surfactant system has a low $\sigma_{L/O}$ (interfacial tension of the surfactant system-containing composition to the greasy soil) preferably less than 4 mN/m measured at a 0.15% total surfactant concentration in deionised water at 25° C.; and a $\sigma_{L/S}$ (interfacial tension of the surfactant system-containing composition to the hard surface) that is lower than the interfacial tension of the greasy soil to be removed to the hard surface to be cleaned ($\sigma_{O/S}$). Low inter facial tension in the thickened liquid hard surface cleaning composition allows composition to penetrate stuck on dirt and then lifts it from the hard surface to be suspended to the wash solution to provide an improved greasy soil and/or particulated greasy soil removal. Interfacial tension is measured according to the method described in patent application WO02/02724 pages 9-11.

By "interfacial tension" it is meant herein, the tension measured between the two phases of substantially non-mixable liquid compositions or between a liquid composition and a solid surface.

By "the interfacial tension of the surfactant system-containing composition to the greasy soil ($\sigma_{L/O}$)" it is meant herein, the interfacial tension between the surfactant system-containing composition and the greasy soil, measured at a 0.15% total surfactant concentration in deionized water at 25° C. Interfacial tension is measured according to the method described in patent application WO02/02724, page 9 lines 14-31 and page 10 lines 1-12.

Preferably, said surfactant system has a $\sigma_{L/O}$ (interfacial tension of the surfactant system-containing composition to the greasy soil) of less than 2 mN/m, more preferably less than 1 mN/m measured at a 0.15% total surfactant concentration in deionized water at 25° C.

By "the interfacial tension of the surfactant system-containing composition to the hard surface ($\sigma_{L/S}$)" it is meant herein, the interfacial tension between the surfactant system and the hard surface to be cleaned. Preferably, the interfacial tension of the surfactant system-containing composition to the hard surface ($\sigma_{L/S}$) is also assessed at a 0.15% total surfactant concentration in deionized water at 25° C. Interfacial tension is measured according the method described in patent application WO02/02724, page 10 lines 14-30 and page 11 lines 1-2.

By "interfacial tension of the greasy soil to the hard surface ($\sigma_{O/S}$)" it is meant herein, the interfacial tension between the greasy soil and the hard surface to be cleaned. The interfacial tension of the greasy soil to the hard surface strongly depends on the type of greasy soil to be found on the hard surface. Interfacial tension is measured according the method described in patent application WO02/02724, page 11, lines 4-9.

The three interfacial tensions described herein are dependent on the physical and/or chemical properties of the surfactant system used, the hard surface to be cleaned and the greasy soil on said surface. However, the physical and/or chemical properties of hard surfaces and the greasy soils depend on the type of hard surface to be cleaned and the type of greasy soil found on said hard surface. Therefore, it is essential for the present invention to choose a suitable surfactant system, providing the interfacial tensions $\sigma_{L/O}$ and $\sigma_{L/S}$ as described herein above. Indeed, to provide a cleaning composition having the specific $\sigma_{L/O}$ (interfacial tension of the surfactant system-containing composition to the greasy soil) and the $\sigma_{L/S}$ (interfacial tension of the surfactant system-containing composition to the hard surface) interfacial tensions any surfactant system known to those skilled in the art providing said specific $\sigma_{L/O}$ and $\sigma_{L/S}$ interfacial tensions may be used.

The surfactant system according to the present invention consists of a sulphated or sulphonated anionic surfactant, a neutralising co-surfactant and an alkoxylated nonionic surfactant.

The thickened liquid hard surface cleaning composition comprises from 1.8% to 20.0% by weight of the composition of said surfactant system, preferably from 4.0% to 18.0%, more preferably from 6.0% to 16.0% and most preferably from 8.0% to 15.0%.

The weight ratio of said anionic surfactant to said neutralizing co-surfactant is from 0.7 to 2.5, preferably from 0.9 to 2.2, more preferably 1.0 to 2.0 and most preferably from 1.1 to 1.8.

The weight ratio of said anionic surfactant to said nonionic surfactant is from 0.15 to 1.0, preferably from 0.2 to 0.75, more preferably from 0.2 to 0.5 and most preferably from 0.2 to 0.45.

The weight ratio of said neutralizing co-surfactant to said nonionic surfactant is from 0.05 to 1.0, preferably from 0.10 to 0.70, more preferably 0.15 to 0.6 and most preferably from 0.15 to 0.50.

All ratios are calculated as a weight/weight level.

Sulphated or Sulphonated Anionic Surfactant

The surfactant system according to the present invention comprises a sulphated or sulphonated anionic surfactant or a mixture thereof.

Suitable sulphated anionic surfactants for use herein are all those commonly known by those skilled in the art. Preferably, the sulphated anionic surfactants for use herein are selected from the group consisting of: alkyl sulphates; and alkylalkoxylated sulphates; and mixtures thereof.

Suitable alkyl sulphates for use herein include water-soluble salts or acids of the formula $ROSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphates include $C_{12-14}$ alkyl sulphate like EMPICOL® 0298/, EMPICOL® 0298/F or EMPICOL® XLB commercially available from ALBRIGHT & WILSON.

By "linear alkyl sulphate" it is meant herein a non-substituted alkyl sulphate wherein the linear alkyl chain comprises from 6 to 16 carbon atoms, preferably from 8 to 14 carbon atoms, and more preferably from 10 to 14 carbon atoms, and wherein this alkyl chain is sulphated at one terminus.

Suitable sulphonated anionic surfactants for use herein are all those commonly known by those skilled in the art. Preferably, the sulphonated anionic surfactants for use herein are selected from the group consisting of: alkyl sulphonates; alkyl aryl sulphonates; naphthalene sulphonates; alkyl alkoxylated sulphonates; and $C_6$-$C_{16}$ alkyl alkoxylated linear or branched diphenyl oxide disulphonates; and mixtures thereof.

Suitable alkyl sulphonates for use herein include water-soluble salts or acids of the formula $RSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{18}$ linear or branched saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphonates include $C_{12}$-$C_{16}$ paraffin sulphonate like Hostapur® SAS commercially available from Hoechst. Particularly preferred alkyl aryl sulphonates are alkyl benzene sulphonates commercially available under trade name Nansa® available from Albright&Wilson.

By "linear alkyl sulphonate" it is meant herein a non-substituted alkyl sulphonate wherein the alkyl chain comprises from 6 to 18 carbon atoms, preferably from 8 to 16 carbon atoms, and more preferably from 10 to 16 carbon atoms, and wherein this alkyl chain is sulphonated at one terminus.

Suitable alkoxylated sulphonate surfactants for use herein are according to the formula $R(A)_mSO_3M$, wherein R is an unsubstituted $C_6$-$C_{18}$ alkyl, hydroxyalkyl or alkyl aryl group, having a linear or branched $C_6$-$C_{18}$ alkyl component, preferably a $C_8$-$C_{16}$ alkyl or hydroxyalkyl, more preferably $C_{12}$-$C_{16}$ alkyl or hydroxyalkyl, and A is an ethoxy or propoxy or butoxy unit, and m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like.

Exemplary surfactants are $C_{12}$-$C_{18}$ alkyl polyethoxylate (1.0) sulphonate ($C_{12}$-$C_{18}$E(1.0)SM), $C_{12}$-$C_{18}$ alkyl polyethoxylate (2.25) sulphonate ($C_{12}$-$C_{18}$E(2.25)SM), $C_{12}$-$C_{18}$ alkyl polyethoxylate (3.0) sulphonate ($C_{12}$-$C_{18}$E(3.0)SM), and $C_{12}$-$C_{18}$ alkyl polyethoxylate (4.0) sulphonate ($C_{12}$-$C_{18}$E(4.0)SM), wherein M is conveniently selected from sodium and potassium. Particularly suitable alkoxylated sulphonates include alkyl aryl polyether sulphonates like Triton X-200® commercially available from Dow Chemical.

Preferably said sulphated or sulphonated anionic surfactant for use herein is selected from the group consisting of alkyl sulphates (AS) preferably $C_{12}$, $C_{13}$, $C_{14}$ and $C_{15}$ AS, sodium linear alkyl sulphonate (NaLAS), sodium paraffin sulphonate $NaPC_{12-16}S$, and mixtures thereof. Most preferably sulphated or sulphonated anionic surfactant for use herein is selected from the group consisting of alkyl sulphates (AS) preferably, $C_{12}$, $C_{13}$, $C_{14}$ and $C_{15}$ AS, sodium linear alkyl sulphonate (NaLAS), sodium paraffin sulphonate $NaPC_{12-16}S$ and mixtures thereof.

Typically, the liquid composition herein may comprise from 0.5% to 9.5% by weight of the total composition of said sulphated or sulphonated anionic surfactant, preferably from 1.0% to 5.0%, more preferably from 1.5% to 3.5% and most preferably from 2.0% to 3.0%.

Neutralising Co-Surfactant

The surfactant system according to the present invention preferably comprises a neutralising co-surfactant. Preferably, said neutralising co-surfactant at least partially neutralises the negative charges of said sulphated or sulphonated anionic surfactant.

Preferably, said neutralising co-surfactant is uncharged or comprises positive and negative charges within the same molecule. More preferably, said neutralising co-surfactant is an (overall) uncharged polar surfactant (with a strong dipole moment) or comprises positive and negative charges within the same molecule. Even more preferably, said neutralising co-surfactant is an uncharged polar surfactant or comprises the same amount of positive and negative charges within the same molecule. Most preferably, said neutralising co-surfactant is not a cationic surfactant.

Any neutralising co-surfactant having the desired property of at least partially neutralising the negative charges of said sulphated or sulphonated anionic surfactant may be used.

Preferred neutralising co-surfactants are selected from the group consisting of: amine oxide surfactants and betaine surfactants and mixtures thereof.

Suitable betaine and sulfobetaine surfactants are according to the formulae:

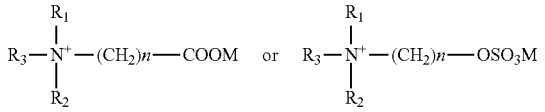

wherein: $R_1$ and $R_2$ are each independently linear or branched, saturated or unsaturated hydrocarbon chains of from 1 to 30 carbon atoms, preferably 1 to 20, more preferably 1 to 7 carbon atoms; $R_3$ is a linear or branched hydrocarbon chain of from 10 to 20 carbon atoms, preferably of from 10 to 18, more preferably 12 to 16 carbon atoms; n is an integer of from 1 to 20, preferably 1 to 10, more preferably 1 to 5; and M is H or an alkali metal, or mixtures thereof.

Suitable betaine surfactant include coconut-dimethyl betaine commercially available under tradename Mackam35® from McIntyre.

Suitable amine oxide surfactants are according to the formula: $R_1R_2R_3NO$ wherein each of $R_1$, $R_2$ and $R_3$ is independently a saturated or unsaturated, substituted or unsubstituted, linear or branched hydrocarbon chain of from 10 to 30 carbon atoms. Preferred amine oxide surfactants to be used according to the present invention are amine oxides having the following formula: $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. $R_1$ may be a saturated or unsaturated, substituted or unsubstituted linear or branched hydrocarbon chain.

Suitable amine oxides for use herein are for instance preferably $C_{12}$-$C_{14}$ dimethyl amine oxide, commercially available from Albright & Wilson, $C_{12}$-$C_{14}$ amine oxides commercially available under the trade name Genaminox® LA from Clariant or AROMOX® DMC from AKZO Nobel.

Preferably, said neutralising co-surfactant is selected from the group consisting of: amine oxide surfactants betaine surfactants and mixtures thereof. More preferably, said neutralising co-surfactant is an amine oxide surfactant.

Typically, the liquid composition herein may comprise from 0.3% to 5.0% by weight of the total composition of said neutralising co-surfactant, preferably from 0.5% to 3.0%, more preferably from 0.7% to 2.5% and most preferably from 1.0% to 2.0%.

Alkoxylated Nonionic Surfactant

The surfactant system according to the present invention further comprises an alkoxylated nonionic surfactant. Suitable alkoxylated nonionic surfactants herein to be mentioned are primaly $C_6$-$C_{16}$ alcohol polyglycol ether i.e. ethoxylated alcohols having 6 to 16 carbon atoms in the alkyl moiety and 4 to 30 ethylene oxide (EO) units. When referred to for example $C_{9-14}$ it is meant average carbons and alternative reference to for example EO8 is meant average ethylene oxide units.

Suitable alkoxylated nonionic surfactants are according to the formula $RO-(A)_nH$, wherein: R is a $C_6$ to $C_{18}$, preferably a $C_8$ to $C_{16}$, more preferably a $C_9$ to $C_{11}$ alkyl chain, or a $C_6$ to $C_{28}$ alkyl benzene chain; A is an ethoxy or propoxy or butoxy unit or a mixture thereof; and wherein n is from 1 to 30, preferably from 1 to 15 and, more preferably from 4 to 12 even more preferably from 5 to 10. Preferred R chains for use herein are the $C_8$ to $C_{22}$ alkyl chains. Even more preferred R chains for use herein are the $C_9$ to $C_{12}$ alkyl chains. Non-capped ethoxy/butoxylated, ethoxy/propoxylated, butoxy/propoxylated and ethoxy/butoxy/propoxylated nonionic surfactants may also be used herein. Preferred non-capped alkoxylated nonionic surfactants are non-capped ethoxylated nonionic surfactants.

Suitable non-capped ethoxylated nonionic surfactants for use herein are Dobanol® 91-2.5 (HLB=8.1; R is a mixture of $C_9$ and $C_{11}$ alkyl chains, n is 2.5), Dobanol® 91-10 (HLB=14.2; R is a mixture of $C_9$ to $C_{11}$ alkyl chains, n is 10), Dobanol® 91-12 (HLB=14.5; R is a mixture of $C_9$ to $C_{11}$ alkyl chains, n is 12), Lialethl® 11-5 (R is a $C_{11}$ alkyl chain, n is 5), Isalchem® 11-21 (R is a mixture of linear mixture of linear and branched $C_{11}$ alkyl chain, n is 5), Lialethl® 11-21 (R is a mixture of linear and branched $C_{11}$ alkyl chain, n is 21), Isalchem® 11-21 (R is a $C_{11}$ branched alkyl chain, n is 21), Empilan® KBE21 (R is a mixture of $C_{12}$ and $C_{14}$ alkyl chains, n is 21) or mixtures thereof. Preferred herein are Dobanol® 91-5, Neodol® 11-5, Lialethl® 11-21 Lialethl® 11-5 Isalchem® 11-5 Isalchem® 11-21 Dobanol® 91-8, or Dobanol® 91-10, or Dobanol® 91-12, or mixtures thereof. These Dobanol®/Neodol® surfactants are commercially available from SHELL. These Lutensol® surfactants are commercially available from BASF and these Tergitol® surfactants are commercially available from Dow Chemicals.

Suitable chemical processes for preparing the alkoxylated nonionic surfactants for use herein include condensation of corresponding alcohols with alkylene oxide, in the desired proportions. Such processes are well known to the person skilled in the art and have been extensively described in the art.

Preferably, said alkoxylated nonionic surfactant is selected from the group consisting of alkoxylated nonionic surfactants and mixtures thereof. More preferably, said alkoxylated nonionic surfactant is a $C_{9-11}$ EO5 alkylethoxylate, $C_{12-14}$ EO5 alkylethoxylate, a $C_{11}$ EO5 alkylethoxylate, $C_{12-14}$ EO21 alkylethoxylate, or a $C_{9-11}$ EO8 alkylethoxylate or a mixture thereof. Most preferably, said alkoxylated nonionic surfactant is a $C_{11}$ EO5 alkylethoxylate or a $C_{9-11}$ EO8 alkylethoxylate or a mixture thereof.

Typically, the thickened liquid composition herein may comprise from 1.0% to 10.0% by weight of the total composition of said alkoxylated non-ionic surfactant, preferably from 3.0% to 9.5%, more preferably from 4.0% to 9.0% and most preferably from 5.0% to 8.0%.

Thickener

The thickened liquid hard surface cleaning composition according to the present invention further comprises thickener. Thickener provides a thicker cleaning composition which gives longer contact time and therefore surfactant system penetrates better on greasy soil and/or particulated greasy soil to improve cleaning effectiveness. Use of a thickener provides a needed product stability.

Suitable thickeners are herein include polyacrylate based polymers, preferably hydrophobically modified polyacrylate polymers; hydroxyl ethyl cellulose, preferably hydrophobically modified hydroxyl ethyl cellulose, xanthan gum, hydrogenated castor oil (HCO) and mixtures thereof.

Preferred thickeners are polyacrylate based polymers, preferably hydrophobically modified polyacrylate polymers. Preferably a water soluble copolymer based on main monomers acrylic acid, acrylic acid esters, vinyl acetate, methacrylic acid, acrylonitrile and mixtures thereof, more preferably copolymer is based on methacrylic acid and acrylic acid esters having appearance of milky, low viscous dispersion. Most preferred hydrologically modified polyacrylate polymer is Rheovis® AT 120, which is commercially available from BASF.

Other suitable thickeners are hydroxethylcelluloses (HM-HEC) preferably hydrophobically modified hydroxyethylcellulose.

Suitable hydroxethylcelluloses (HM-HEC) are commercially available from Aqualon/Hercules under the product name Polysurf 76® and W301 from 3V Sigma.

Xanthan gum is one suitable thickener used herein. Xanthan gum is a polysaccharide commonly used rheoligy modifier and stabilizer. Xanthan gum is produced by fermentation of glucose or sucroce by the *xanthomonas campestris* bacterium.

Suitable Xanthan gum is commercially available under trade anem Kelzan T® from CP Kelco.

Hydrogenated castor oil is one suitable thickener used herein. Suitable hydrogenated castor oil is available under trade name TIXCIN R from Elementis.

The most preferred thickener used herein is hydrologically modified polyacrylate polymer Rheovis® AT 120, which is commercially available from BASF.

Typically, the thickened liquid composition herein comprises from 0.1% to 10.0% by weight of the total composition of said thickener, preferably from 0.2% to 5.0%, more preferably from 0.2% to 2.5% and most preferably from 0.2% to 2.0%.

Chelating Agents

The thickened liquid hard surface cleaning composition according to the present invention further comprises chelating agent or mixtures thereof. Suitable chelating agents, in combination with the surfactant system, improve the shine benefit.

Chelating agent can be incorporated in the compositions herein in amounts ranging from 0.05% to 5.0% by weight of the total composition, preferably from 0.1% to 3.0%, more preferably from 0.2% to 2.0% and most preferably from 0.2% to 0.4%.

Suitable phosphonate chelating agents for use herein may include ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agent to be used herein is diethylene triamine penta methylene phosphonate (DTPMP). Such phosphonate chelating agents are commercially available from Monsanto under the trade name DEQUEST®.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Most preferred biodegradable chelating agent is L-glutamic acid N,N-diacetic acid (GLDA) commercially available under tradename Dissolvine 47S from Akzo Nobel.

Suitable amino carboxylates for use herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanoldiglycines, and methyl glycine diacetic acid (MGDA), both in their acid form, or in their alkali metal, ammonium, and substituted ammonium salt forms. Particularly suitable amino carboxylate to be used herein is propylene diamine tetracetic acid (PDTA) which is, for instance, commercially available from BASF under the trade name Trilon FS® and methyl glycine di-acetic acid (MGDA). Most preferred aminocarboxylate used herein is diethylene triamine pentaacetate (DTPA) from BASF.

Further carboxylate chelating agents for use herein include salicylic acid, aspartic acid, glutamic acid, glycine, malonic acid or mixtures thereof.

Polymers

The thickened composition according to the present invention may further comprise a polymer as highly preferred optional ingredient. It has been found that the presence of a specific polymer as described herein, when present, allows further improving the grease removal performance of the thickened liquid composition due to the specific sudsing/foaming characteristics they provide to said composition. Suitable polymers for use herein are disclosed in co-pending EP patent application EP2272942 (09164872.5) and granted European patent EP2025743 (07113156.9).

The polymer can be selected from the group consisting of: a vinylpyrrolidone homopolymer (PVP); a polyethyleneglycol dimethylether (DM-PEG); a vinylpyrrolidone/dialkylaminoalkyl acrylate or methacrylate copolymers; a polystyrenesulphonate polymer (PSS); a poly vinyl pyridine-N-oxide (PVNO); a polyvinylpyrrolidone/vinylimidazole copolymer (PVP-VI); a polyvinylpyrrolidone/polyacrylic acid copolymer (PVP-AA); a polyvinylpyrrolidone/vinylacetate copolymer (PVP-VA); a polyacrylic polymer or polyacrylicmaleic copolymer; and a polyacrylic or polyacrylic maleic phosphono end group copolymer; and mixtures thereof.

Typically, the liquid composition herein may comprise from 0.005% to 5.0% by weight of the total composition of said polymer, preferably from 0.10% to 4.0%, more preferably from 0.1% to 3.0% and most preferably from 0.20% to 1.0%.

Fatty Acid

The thickened liquid compositions of the present invention may comprise fatty acid, or mixtures thereof as a highly preferred optional ingredient. Fatty acids are desired herein as they reduce the sudsing of the thickened liquid composition according to the present invention when the composition is rinsed of the surface to which it has been applied before.

Suitable fatty acids for use herein are the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms.

Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil.

For example coconut fatty acid is commercially available from UNICHEMA under the name PRIFAC 5900®.

Typically, the liquid composition herein may comprise up to 6.0% by weight of the total composition of said fatty acid, preferably from 0.1% to 3.0%, more preferably from 0.1% to 2.0% and most preferably from 0.15% to 1.5% by weight of the total composition of said fatty acid.

Branched Fatty Alcohol

The thickened liquid compositions of the present invention may comprise a branched fatty alcohol, or mixtures thereof as a highly preferred optional ingredient.

Suitable branched fatty alcohols to be used in the present invention are the 2-alkyl alkanols having an alkyl chain comprising from 6 to 16, preferably from 7 to 13, more preferably from 8 to 12, most preferably from 8 to 10 carbon atoms and a terminal hydroxy group, said alkyl chain being substituted in the a position (i.e., position number 2) by an alkyl chain comprising from 1 to 10, preferably from 2 to 8 and more preferably 4 to 6 carbon atoms.

Such suitable compounds are commercially available, for instance, as the Isofol® series such as Isofol® 12 (2-butyl octanol) or Isofol® 16 (2-hexyl decanol) commercially available from Condea.

Typically, the liquid composition herein may comprise up to 2.0% by weight of the total composition of said branched fatty alcohol, preferably from 0.10% to 1.0%, more preferably from 0.1% to 0.8% and most preferably from 0.1% to 0.5%.

Solvent

The thickened liquid compositions of the present invention may comprise a solvent or mixtures thereof as a preferred optional ingredient.

Suitable solvent is selected from the group consisting of: ethers and diethers having from 4 to 14 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof.

Perfumes

The thickened liquid compositions of the present invention may comprise a perfume or a mixture thereof as a highly preferred optional ingredient. Suitable perfumes for use herein include materials which provide an olfactory aesthetic benefit and/or cover any "chemical" odour that the product may have.

Other Optional Ingredients:

The thickened liquid compositions according to the present invention may comprise a variety of other optional ingredients depending on the technical benefit aimed for and the surface treated.

Suitable optional ingredients for use herein include builders, polymers, buffers, bactericides, hydrotropes, colorants, stabilisers, radical scavengers, abrasives, soil suspenders, dye transfer agents, brighteners, anti dusting agents, dispersants, dye transfer inhibitors, pigments, silicones and/or dyes.

Packaging Form of the Compositions

The thickened liquid compositions herein may be packaged in a variety of suitable detergent packaging known to those skilled in the art. Preferably, the liquid compositions are packaged in conventional detergent plastic bottles.

In another preferred embodiment the thickened compositions herein may be packed in a bottle comprising a specific metered dosing cap to deliver accurate dose of product. Preferably the thickened compositions herein are packed in bottles comprising a dispensing devise as described in copending patent application EP 10188349.4.

In one embodiment the compositions herein may be packaged in manually or electrically operated spray dispensing containers, which are usually made of synthetic organic polymeric plastic materials. Accordingly, the present invention also encompasses thickened liquid hard surface cleaning compositions of the invention packaged in a spray dispenser, preferably in a trigger spray dispenser or pump spray dispenser.

In yet another embodiment, a thickened liquid hard surface cleaning composition according to the present invention is loaded on a cleaning substrate, whereas the substrate is a paper or nonwoven towel or wipe or a sponge.

The Process of Cleaning a Surface

The present invention encompasses a process of cleaning a surface with a thickened liquid composition according to the present invention. Suitable surfaces herein are described herein above under the heading "The thickened liquid hard surface cleaning composition".

In a preferred embodiment said surface is contacted with the composition according to the present invention, preferably wherein said composition is applied onto said surface.

In another preferred embodiment, the process herein comprises the steps of dispensing (e.g., by spraying, pouring, squeezing) the thickened liquid composition according to the present invention from a container containing said liquid composition and thereafter cleaning said surface.

A preferred embodiment of the present invention provides that the thickened liquid composition is applied onto the surface to be treated. The composition may be in its neat form or in its diluted form.

By "diluted form", it is meant herein that said thickened liquid composition is diluted by the user typically with water. The composition is diluted prior to use to a typical dilution level of 10 to 400 times its weight of water, preferably from 10 to 200 and more preferably from 10 to 100. A usually recommended dilution level is from 1.2% to 1.5% dilution of the composition in water, for concentrated compositions recommended dilution level is from 0.4% to 0.6% dilution of the composition in water.

By "in its neat form", it is to be understood that said thickened liquid composition is applied directly onto the surface to be treated without undergoing any dilution, i.e., the liquid composition herein is applied onto the hard surface as described herein.

In a preferred embodiment of the present invention said hard surface is inclined or vertical. Inclined or vertical hard surfaces include minors, lavatory pans, urinals, drains, waste pipes and the like.

In another embodiment of the present invention said liquid composition is poured onto said hard surface. More preferably, said liquid composition is poured in its neat form onto said hard surface.

In another preferred embodiment of the present invention said process of cleaning a hard surface includes the steps of applying, preferably spraying, said liquid composition onto said hard surface, leaving said liquid composition to act onto said surface for a period of time to allow said composition to act, preferably without applying mechanical action, and optionally removing said liquid composition, preferably removing said liquid composition by rinsing said hard surface with water and/or wiping said hard surface with an appropriate instrument, e.g., a sponge, a paper or cloth towel and the like.

The hard surfaces to be treated may be soiled with a variety of soils, e.g., greasy soils (e.g., greasy soap scum, body grease, kitchen grease or burnt/sticky food residues typically found in a kitchen and the like), particulate greasy soils.

Neat Cleaning Performance Test Method

The cleaning performance may be evaluated by the following test methods:

On horizontal surfaces:

Kitchen or bath tiles (ceramic, enamel or stainless steel) are prepared by applying to them a representative grease- or grease/particulate-artificial soil followed by ageing (2 hours at 130° C.) of the soiled tiles. The test composition is evaluated by applying a small amount of product (e.g., 5 to 10 ml) directly to the soiled tiles and letting the test composition to act for some time (e.g., up to 1 minute). The test composition is afterwards removed from said tile either by wiping the composition of or rinsing the tile. The cleaning performance is evaluated by measuring the number of cycles needed to get a clean surface versus a reference. The result, i.e., the number of cycles, of the test composition is compared against the result of a reference composition. Alternatively, the cleaning performance may be evaluated either by visually grading the tiles or by using a Colorimeter® Gloss meter. The visual grading may be performed by a group of expert panellists using panel score units (PSU). To assess the cleaning performance benefits of a given composition a PSU-scale ranging from 0, meaning no noticeable difference in cleaning performance versus a reference composition, to 4, meaning a noticeable difference in cleaning performance versus a reference composition, can be applied.

Shine Test Under Soiled Conditions

The shine test is done with soil mixture which consists of a mixture of consumer relevant soils such as oil, particulates, pet hair, sugar etc. The black glossy ceramic tiles are soiled with the soil mixture and cleaned with the thickened liquid hard surface cleaning composition(s) and results are analysed by using grading described below.

| Grading in absolute scale: |
|---|
| 0 = as new/no streaks and/or film |
| 1 = very slight streaks and/or film |
| 2 = slight streaks and/or film |
| 3 = slight to moderate streaks and/or film |
| 4 = moderate streaks and/or film |
| 5 = moderate/heavy streaks and/or film |
| 6 = heavy streaks and/or film |
| and PSU Scale: |
| 0 = I see no difference |
| 1 = I think there is difference |
| 2 = I am sure there is a slight difference |
| 3 = I am sure there is a difference |
| 4 = I am sure there is a big difference |

Three batches with different technologies have been tested in test 1:

Product 1: Single surfactant (only non ionic): 9.5% $C_{9/11}EO_8$

Product 2: Dual surfactant (non ionic/anionic): 4.75% $C_{9/11}EO_8$+4.75% HLAS

Product 3: Triple surfactant system: 6.0% $C_{9/11}/EO_8$+2.25% HLAS+1.25% $C_{12/14}$ AO all the other ingredients are kept the same: perfume, chelants, buffers, perfume and dye, same final pH=10.5, same total surfactants at 9.5%.

With these products have been performed different types of shine and cleaning tests:

Test A=neat shine test on windows. 1 ml product has been put on a damped sponge and cleaned a surface 0.5 m-0.5 m. Let it dry and grade.

Test B=shine A and before grading an extra rinse step and then grading.

Dilute shine soiled conditions (described above).

Neat cleaning performance test (described above).

TABLE 1

Cleaning tests performed with three different kinds of surfactant systems. Product 3 comprises surfactant system according to the present invention.

| Test 1 | Product 1 | Product 2 | Product 3 |
|---|---|---|---|
| Test A | 4.75 | 3.75 (+2 PSU) | 3 (+2.5 PSU) |
| Test B | 3.33 | 5.00 (−2.33) | 2.33 (+1.5) |
| Dilute shine soiled conditions | 3.0 | 4.0 (−2.0) | 3.0 (+1.0) |
| Neat cleaning performance | Strokes 92.5 Cleaning index 100 | Strokes 71.75 Cleaning index 129 | Strokes 59.50 Cleaning index 155 |

The data in the table 1 shows that with the same level of total surfactants, an overall benefit is observed on shine and cleaning performance with the triple surfactant system according to the present invention.

Additionally two different kinds of compositions were prepared for comparative testing in test 2.

Product 4: sodium paraffin sulfonate 4.0%, orange terpenes 2.0%, butyl carbitol 1.5%, sodium citrate 3.0%, sodium coconut soap 0.3%, cumene sulfonate 1.8%, sodium carbonate 5.0%, xantan gum 0.1% perfume 0.2% and balance water.

Product 4 comprises one surfactant and is slightly thickened, however viscosity is lower compared to the compositions according to the present invention. Additionally product 4 comprises high levels of terpenes and solvents and is well buffered.

Product 5: Alkyl benzene sulfonate (Na) 3.0%, ethoxylated (EO7) coconut alcohols 3.0%, dimethyldodecylamine oxide 2.0%, α-pinene 0.2%, β-pinene 0.2%, d-limolene 0.4%, dipentene 0.4%, pine oil 0.1%, sodium coconut soap 0.45%, cumene sulfonate 1.2%, sodium nitrilotriacetate 2.0%, sodium tripolyphosphate 1.5%, butyl carbitol 3.0%, water balance, NaOH to pH 10.6.

Product 5 comprises three surfactants and is not thickened. Additionally product 5 contains solvents, terpenes and salts.

TABLE 2

Cleaning tests performed with four different kinds of compositions. Product 3 comprises surfactant system according to present invention, product 2 comprises dual surfactant system and products 4 and 5 are compositions comprising surfactants, terpenes and solvents.

| Test 2 | Product 3 | Product 4 | Product 5 | Product 2 |
|---|---|---|---|---|
| Test A | 2.0 | 3.0 | 5.87 | 3.75 |
| Test B | 1.33 | 3.5 | 1.67 | 5.0 |
| Dilute shine soiled conditions | 2.5 (reference) | 4.5 (−2.75) filming | 5.0 (−3.0) filming | 3.7 (−2.0) |
| Neat cleaning performance | Strokes 39.8 Cleaning index 100 | Strokes 45.0 Cleaning index 88 s | Strokes 39.8 Cleaning index 100 ns | Strokes 55.8 Cleaning index 71 s |

The data in the table 2 shows that a thickened triple surfactant system according to the present invention is needed to perform well both on shine and cleaning, despite of the high level of builders and/or solvents in comparative examples.

EXAMPLES

The following examples will further illustrate the present invention. The compositions are made by combining the listed ingredients in the listed proportions (weight % unless otherwise specified). The following Examples are meant to exemplify compositions used in a process according to the present invention but are not necessarily used to limit or otherwise define the scope of the present invention.

| | A | B | C | D | E | F | G | H | I |
|---|---|---|---|---|---|---|---|---|---|
| Non ionic | | | | | | | | | |
| C9/11 EO 8 | 6.0 | 6.0 | 7.0 | | | 6.0 | 6.2 | 6.0 | 6.2 |
| C9/11 EO 5 | | | | 3.5 | | | | | |
| C12/14 EO 21 | | | | 3.5 | | | | | |
| C11 EO 5 | | | | | 7.0 | | | | |
| Anionic | | | | | | | | | |
| NaLAS | 2.00 | 2.25 | 1.8 | | | | 1.80 | 2.25 | 1.80 |
| NAPS | | | | 3.1 | 3.0 | 3.0 | | | |
| C12-14 AS | | | | | | | | | |
| NaCS | | | | | | | | | |
| Co surfactants | | | | | | | | | |
| C12-14 AO | 1.50 | 1.25 | 1.50 | 3.9 | 2.0 | | 1.50 | 1.25 | 1.50 |
| C12-14 Betaine | | | | | 1.0 | 3.0 | | | |
| Thickeners | | | | | | | | | |
| HM-polyacrylate | 0.76 | 0.65 | 0.75 | | | | 0.70 | 0.65 | 0.65 |
| HM-HEC | | | | 0.6 | 0.8 | | | | |
| X gum | | | | | | 0.42 | | | |
| Buffer | | | | | | | | | |
| Na2CO3 | 0.77 | 0.4 | 0.75 | 0.1 | 0.3 | 0.2 | 0.75 | 0.4 | 0.75 |
| Citric Acid | 0.046 | 0.3 | 0.3 | 0.75 | 0.75 | 0.3 | 0.3 | 0.3 | 0.30 |
| Caustic | 0.46 | 0.76 | 0.72 | 0.5 | 0.5 | 0.3 | 0.65 | 0.65 | 0.66 |
| Suds control | | | | | | | | | |
| Fatty Acid | 0.40 | 1.0 | 1.0 | 0.20 | 0.50 | 0.50 | 0.40 | 0.40 | 1.0 |
| Branched fatty alcohols | | | | | | | | | |
| Isofol 12 | | 0.2 | 0.1 | 0.2 | 0.3 | 0.5 | | | 0.1 |
| Isofol 16 | | | | | | | | | |
| Chelants | | | | | | | | | |
| DTPMP | | 0.3 | 0.30 | | | 0.2 | | | 0.3 |
| DTPA | 0.25 | | | | | | 0.25 | 0.25 | |
| GLDA | | | | | | | | | |
| Solvents | | | | | | | | | |
| IPA | | | | | | 2.0 | | | |
| n-BPPP | | | | | 2.0 | | | | |
| N-BP | | | | 4.0 | 2.0 | | | 2.0 | |
| Minors and Water | up to 100% | up to 100% | up to 100% | up to 100% | up to 100% | up to 100% | up to 100% | up to 100% | up to 100% |
| pH | 10.6 | 10.5 | 10.3 | 9.5 | 9.0 | 10.0 | 10.3 | 10.5 | 10.3 |

$C_{9-11}$ $EO_5$ is a $C_{9-11}$ $EO_5$ nonionic surfactant commercially available from ICI or Shell. $C_{12,14}$ $EO_5$ is a $C_{12,14}$ $EO_5$ nonionic surfactant commercially available from Huls, A&W or Hoechst. $C_{11}$ $EO_5$ is a $C_{11}$ $EO_5$ nonionic surfactant. $C_{12,14}$ $EO_{21}$ is a $C_{12-14}$ $EO_{21}$ nonionic surfactant. NaPS is Sodium Paraffin sulphonate commercially available from Huls or Hoechst. NaLAS is Sodium Linear Alkylbenzene sulphonate commercially available from A&W. NaCS is Sodium Cumene sulphonate commercially available from A&W. Isalchem® AS is a $C_{12-13}$ sulphate surfactant commercially available from Sasol olefins and surfactants. $C_{12-14}$ AO is a $C_{12-14}$ amine oxide surfactant. $C_{12-14}$ Betaine is a $C_{12-14}$ betaine surfactant.

DMPEG is a polyethyleneglycol dimethylether. HM-HEC is a cetylhydroxethylcellulose. Isofol 12® is 2-butyl octanol commercially available from Condea. Isofol 16® is 2-hexyl decanol commercially available from Condea. n-BP is normal butoxy propanol commercially available from Dow Chemicals. IPA is isopropanol.

n-BPP is butoxy propoxy propanol available from Dow Chemicals.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A thickened liquid hard surface cleaning composition comprising:

a) about 1.8% to about 20.0% by weight of the composition of a surfactant system, comprising an alkoxylated nonionic surfactant, a sulphated or sulphonated anionic surfactant; and a neutralizing co-surfactant, wherein the weight ratio of said anionic surfactant to said neutralizing co-surfactant is from about 0.7 to about 2.5 and the weight ratio of said anionic surfactant to said nonionic surfactant is from about 0.15 to about 1.0, and the weight ratio of said neutralizing co-surfactant to said nonionic surfactant is from about 0.05 to about 1.0;

b) about 0.1% to about 10.0% by weight of the composition of a thickener or mixture thereof;

c) about 0.05% to about 5.0% by weight of the composition of a chelant or mixture thereof;

d) a solvent selected from the group consisting of ethers having from 4 to 14 carbon atoms, diethers having from 4 to 14 carbon atoms, glycols, alkoxylated glycols, alkoxylated aromatic alcohols, aromatic alcohols, alkoxylated aliphatic alcohols, aliphatic alcohols, $C_8$-$C_{14}$ alkyl hydrocarbons, $C_8$-$C_{14}$cycloalkyl hydrocarbons, $C_8$-$C_{14}$ alkyl halohydrocarbons, $C_8$-$C_{14}$cycloalkyl halohydrocarbons, $C_6$-$C_{16}$ glycol ethers, and mixtures thereof; and e) water, wherein said composition has a pH from about 9.0 to about 11.0 and a viscosity from about 50 cps to about 600 cps measured at 20° C. with a AD1000 Advanced Rheometer from Atlas® with shear rate of 10 $s^{-1}$ with a coned spindle of 40 mm with a cone angle of about 2° and a truncation of ±60 μm, wherein said neutralizing co-surfactant is selected from the group consisting of $C_{12}$-$C_{14}$ amino oxide, $C_{12}$-$C_{14}$ betaine and mixtures thereof.

2. A thickened liquid hard surface cleaning composition according to claim 1, wherein said alkoxylated nonionic surfactant is selected from the group consisting of $C_{9-11}$ EO5 alkylethoxylate; $C_{12-14}$ EO5 alkylethoxylate; $C_{11}$ EO5 alkylethoxylate; $C_{12-14}$ EO21 alkylethoxylate; or $C_{9-11}$ EO8 alkylethoxylate; and a mixture thereof, more preferably said alkoxylated nonionic surfactant is a $C_{11}$ EO5 alkylethoxylate or a $C_{9-11}$ EO8 alkylethoxylate or a mixture thereof.

3. A thickened liquid hard surface cleaning composition according to claim 2, wherein said sulphated or sulphonated anionic surfactant is selected from the group consisting of alkyl sulphates, sodium linear alkyl sulphonate, sodium paraffin sulphonate and mixtures thereof.

4. A thickened liquid hard surface cleaning composition according to claim 1, wherein said thickener is selected from the group consisting of hyrdrolocically modified acryl polymers, hydrologically modified hydroxyethylcellulose, xanthan gum, hydrogenated castor oil and mixtures thereof.

5. A thickened liquid hard surface cleaning composition according to claim 4, wherein said chelant is selected from the group consisting of diethylene triamine pentamethylene phosphonate (DTPMP), diethylene triamine pentaacetate (DTPA), L-glutamic acid N,N-diacetic acid (GLDA) and mixtures thereof.

6. A thickened liquid cleaning composition according to claim 1 comprising from about 4.0% to about 18% by weight of the composition of said surfactant system.

7. A thickened liquid cleaning composition according to claim 1 comprising from about 8.0% to about 15% by weight of the composition of said surfactant system.

8. A thickened liquid hard surface cleaning composition according to claim 1, wherein the weight ratio of said anionic surfactant to said neutralizing co-surfactant is from about 0.9 to about 2.2.

9. A thickened liquid hard surface cleaning composition according to claim 1, wherein the weight ratio of said anionic surfactant to said neutralizing co-surfactant is from about 1.0 to about 2.0.

10. A thickened liquid hard surface cleaning composition according to claim 1, wherein the weight ratio of said anionic surfactant to said nonionic surfactant is from about 0.2 to about 0.75.

11. A thickened liquid hard surface cleaning composition according to claim 1, wherein the weight ratio of said anionic surfactant to said nonionic surfactant is from about 0.2 to about 0.5.

12. A thickened liquid hard surface cleaning composition according to claim 1, wherein the weight ratio of said neutralizing co-surfactant to said nonionic surfactant is from about 0.10 to about 0.7.

13. A thickened liquid hard surface cleaning composition according to claim 1, wherein the weight ratio of said neutralizing co-surfactant to said nonionic surfactant is from about 0.15 to about 0.6.

14. A thickened liquid hard surface cleaning composition according to claim 1 having pH from about 9.5 to about 10.8.

15. A thickened liquid hard surface cleaning composition according to claim 1 having viscosity from about 100 cps to about 500 cps.

16. A thickened liquid hard surface cleaning composition according to claim 1 having viscosity from about 150 cps to about 350 cps.

17. A thickened liquid cleaning composition according to claim 1, wherein the cleaning composition is loaded on a cleaning substrate, wherein the substrate is a paper or nonwoven towel or wipe or a sponge.

18. A process of cleaning a surface with a thickened liquid cleaning composition according to claim 1, wherein said surface is contacted with said composition, wherein said composition is applied onto a hard surface, selected from the group consisting of household hard surfaces; dish surfaces; leather, or synthetic leather; and automotive vehicles surfaces.

19. A thickened liquid hard surface cleaning composition comprising:

a) about 1.8% to about 20.0% by weight of the composition of a surfactant system, comprising an alkoxylated nonionic surfactant, a sulphated or sulphonated anionic surfactant; and a neutralizing co-surfactant, wherein the weight ratio of said anionic surfactant to said neutralizing co-surfactant is from about 0.7 to about 2.5 and the weight ratio of said anionic surfactant to said nonionic surfactant is from about 0.15 to about 1.0, and the weight ratio of said neutralizing co-surfactant to said nonionic surfactant is from about 0.05 to about 1.0;

b) about 0.1% to about 10.0% by weight of the composition of a thickener or mixture thereof;

c) about 0.05% to about 5.0% by weight of the composition of a chelant or mixture thereof; and d) water, wherein said composition has a pH from about 9.0 to about 11.0 and a viscosity from about 50 cps to about 600 cps measured at 20° C. with a AD1000 Advanced Rheometer from Atlas® with shear rate of 10 $s^{-1}$ with a coned spindle of 40 mm with a cone angle of about 2° and a truncation of ±60 μm, wherein said composition does not include a solvent, wherein said neutralizing co-surfactant is selected from the group consisting of $C_{12}$-$C_{14}$ amino oxide, $C_{12}$-$C_{14}$ betaine and mixtures thereof.

* * * * *